US006577223B2

(12) United States Patent
Takeda

(10) Patent No.: US 6,577,223 B2
(45) Date of Patent: Jun. 10, 2003

(54) THERMAL PROTECTOR

(75) Inventor: Hideaki Takeda, Misato (JP)

(73) Assignee: Uchiya Thermostat Co., Ltd., Saitama (JP)

( * ) Notice: Subject to any disclaimer, the term of this patent is extended or adjusted under 35 U.S.C. 154(b) by 49 days.

(21) Appl. No.: 09/972,880

(22) Filed: Oct. 10, 2001

(65) Prior Publication Data

US 2002/0044039 A1 Apr. 18, 2002

(30) Foreign Application Priority Data

Oct. 13, 2000 (JP) ..... 2000-314006

(51) Int. Cl.[7] ..... H01H 37/14; H01H 37/54

(52) U.S. Cl. ..... 337/377; 337/333; 337/343; 337/77

(58) Field of Search ..... 337/102, 103, 337/104, 16, 36, 97, 298, 333, 343, 377, 390, 53, 77, 100

(56) References Cited

U.S. PATENT DOCUMENTS

| | | | | | |
|---|---|---|---|---|---|
| 3,840,834 | A | * | 10/1974 | Obenhaus et al. | 337/79 |
| 4,580,123 | A | * | 4/1986 | Roller et al. | 337/103 |
| 4,862,132 | A | * | 8/1989 | Hollweck | 337/102 |
| 4,862,133 | A | * | 8/1989 | Tabei | 337/102 |
| 5,039,843 | A | * | 8/1991 | Muller | 219/511 |
| 5,182,538 | A | * | 1/1993 | Muller | 337/102 |
| 5,309,131 | A | * | 5/1994 | Hofsass et al. | 337/102 |
| 5,367,279 | A | * | 11/1994 | Sakai | 337/104 |
| 5,607,610 | A | * | 3/1997 | Furukawa | 219/505 |
| 5,659,285 | A | * | 8/1997 | Takeda | 337/389 |
| 5,936,510 | A | * | 8/1999 | Wehl et al. | 337/377 |
| 5,973,587 | A | * | 10/1999 | Hofsass | 337/377 |
| 6,020,807 | A | * | 2/2000 | Givler | 337/377 |
| 6,031,447 | A | * | 2/2000 | Hofsass | 337/377 |
| 6,133,817 | A | * | 10/2000 | Hofsass et al. | 337/377 |
| 6,181,233 | B1 | * | 1/2001 | Hofsass et al. | 337/377 |
| 6,249,210 | B1 | * | 6/2001 | Hofsass | 337/324 |
| 6,300,860 | B1 | * | 10/2001 | Hofsass | 337/377 |
| 6,396,381 | B1 | * | 5/2002 | Takeda | 337/377 |

FOREIGN PATENT DOCUMENTS

| | | | | |
|---|---|---|---|---|
| JP | 01246737 A | * | 10/1989 | H01H/37/54 |
| JP | A8 222103 | | 8/1996 | |

* cited by examiner

*Primary Examiner*—Anatoly Vortman
(74) *Attorney, Agent, or Firm*—Birch, Stewart, Kolasch & Birch, LLP

(57) ABSTRACT

A first contact portion 10*a* is projectingly provided at a part of a first terminal 10 in the direction so as to intersect a bimetal plate 90, and a second contact portion 20*a* is projectingly provided at a part of a second terminal 20 so as to be opposed to the first contact portion 10*a*. A heat generating resistor 30 is interposed between the first contact portion 10*a* and the second contact portion 20*a* so that electrodes on one end face and the other end face of the heat generating resistor 30 are in contact with the first contact portion 10*a* and the second contact portion 20*a*, respectively.

6 Claims, 5 Drawing Sheets

THERMAL PROTECTOR

FIELD OF THE INVENTION AND RELATED ART STATEMENT

The present invention relates to a thermal protector used as means of preventing overheating of electrical equipment accompanied by heat generation such as a fan heater.

FIG. 5 shows a thermal protector disclosed in Japanese Patent Provisional Publication No. 8-222103. In this thermal protector, when electrical equipment such as a fan heater to which the thermal protector is applied generates heat, a bimetal plate 1 performs reversing operation to push up a movable plate 2. Therefore, a movable contact 2 provided at the distal end of the movable plate 2 separates from a fixed contact 3, by which the flow of electric current to the electrical equipment is ceased.

The cease of current flow decreases the heat generation in the electrical equipment. Even when the heat generation temperature becomes lower than the reversing operation temperature of the bimetal plate 1, this electricity shut-off state is maintained. The reason for this is that a heat generating resistor 6 consisting of a thermistor or the like, which is interposed between terminals 4 and 5, generates heat at the same time the contact point 2 separates from the contact point 3, by which the bimetal plate 1 is heated continuously. A function of continuously maintaining the electricity shut-off state (self holding function) is deactivated, for example, by turning off a power switch for the electrical equipment.

For the conventional thermal protector, the heat generating resistor 6 is mounted in such a manner that one and the other electrodes thereof are positioned on the top and bottom faces, respectively. The electrode on the top face side is brought into contact with a plate 7, and the electrode on the bottom face side is brought into contact with the top face of an extension 4*a* of the terminal 4.

When a construction in which current is carried from the top and bottom faces of the heat generating resistor 6 is used as described above, the size in the thickness direction increases because of the layout of the current-carrying members 7 and 4. Also, construction members must be fixed by tightening rivets 8 and 9, so that much time and labor are required for assembling work.

In order to decrease the size in the thickness direction, the thickness of the resistor 6 may possibly be decreased. In this case, however, the resistor 6 cannot withstand a pressure sufficiently. Also, insulation distances between the plate 7 and the rivet 8 and between the extension of the terminal 4 and the rivet 9 cannot be secured.

There have been proposed a thermal protector in which an electrode plate that is brought into contact with an electrode of a heat generating resistor is provided separately from a terminal, and a thermal protector in which one face of a heat generating resistor is brought into contact with a part of a terminal. Both of these thermal protectors have drawbacks in that the number of parts and the manpower for assembling work increase, resulting in high cost and in that a larger space is required to incorporate the resistor, resulting in increased body shape.

OBJECT AND SUMMARY OF THE INVENTION

The present invention has been made in view of the above situation, and accordingly an object thereof is to provide a thermal protector capable of incorporating a heat generating resistor without an increase in cost and body shape.

To achieve the above object, the present invention provides a thermal protector comprising first and second terminals connected to external circuits and a heat generating resistor provided with electrodes connected electrically to the first and second terminals on one end face and the other end face thereof, which is constructed so that first and second electrical contacts interposed between the first and second terminals are opened and closed by using the reversing operation of a bimetal plate, wherein a first contact portion is projectingly provided at a part of the first terminal in the direction so as to intersect the bimetal plate, and a second contact portion is projectingly provided at a part of the second terminal so as to be opposed to the first contact portion; and the heat generating resistor is interposed between the first and second contact portions so that the electrodes on one end face and the other end face of the heat generating resistor are brought into contact with the first and second contact portions, respectively.

According to the present invention, since the first and second contact portions serving as current carrying members to the heat generating resistor are provided in the direction so as to intersect the bimetal plate, that is, the contact portions are not in parallel with the bimetal plate, the dimension in the thickness direction can be decreased, so that a compact thermal protector can be realized. That is to say, the dimension in the thickness direction can be made approximately equal to that of a thermal protector of a type having no heat generating resistor. Therefore, the degree of freedom in designing equipment to which the thermal protector is applied increases.

In an embodiment of the present invention, a part of each of the first and second terminals is cut and raised to form first and second support portions, respectively; the proximal end portion of an elastic movable plate provided with the first contact at the distal end thereof is supported by the first support portion, and the second contact opposed to the first contact is supported by the second support portion; and the movable plate is operated by the reversing operation of the bimetal plate so that the first contact is brought into contact with and separated from the second contact.

According to this configuration, the number of additional parts for mounting the heat generating resistor decreases, so that the assembling work can be made easy, and the cost can be decreased.

In an embodiment of the present invention, an elastic element having electric conductivity is interposed between the electrode on one end face of the heat generating resistor and the first contact portion or between the electrode on the other end face of the heat generating resistor and the second contact portion.

According to this configuration, thermal expansion and contraction of each part caused when the thermal protector is used in an environment in which the rise and fall in temperature are repeated are absorbed by the elastic element, so that each of the contact portions can always be brought into contact with the electrode of the heat generating resistor with a proper contact pressure.

In an embodiment of the present invention, an electrical insulating resin block is provided to connect the first and second terminals to each other, and the resin block is provided with a concave for housing the heat generating resistor so that the first and second contact portions are exposed from the opposed inside faces of the concave and the top face of the heat generating resistor is in contact with the bottom face of the concave.

According to this configuration, the heat generated in the heat generating resistor can be dissipated from three faces thereof. Therefore, a larger quantity of heat can be generated by the heat generating resistor.

In an embodiment of the present invention, a groove is formed in the bottom face of the concave in the resin block in the direction along the face of the electrode of the heat generating resistor.

According to this configuration, a space is formed between the bottom face of the concave and the top face of the heat generating resistor, so that the electrical insulation performance between the electrodes of the heat generating resistor can be enhanced when the thermal protector is used in a state of dew condensation.

In an embodiment of the present invention, the elastic element is provided with a holding portion for holding the heat generating resistor in cooperation with the bottom face of the concave in the resin block.

According to this configuration, the heat generating resistor can be held more reliably.

DETAILED DESCRIPTION OF PREFERRED EMBODIMENTS

Figure 1:
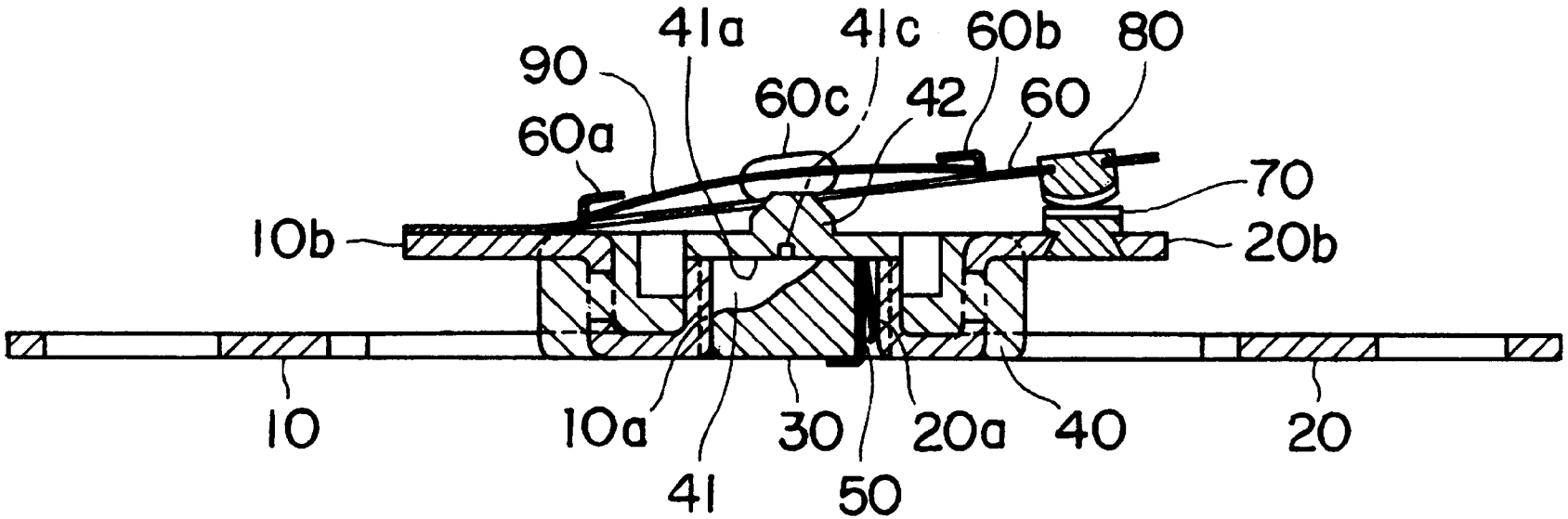
FIG. 1 is a central longitudinal sectional view of an embodiment of a thermal protector in accordance with the present invention.
Figure 2:
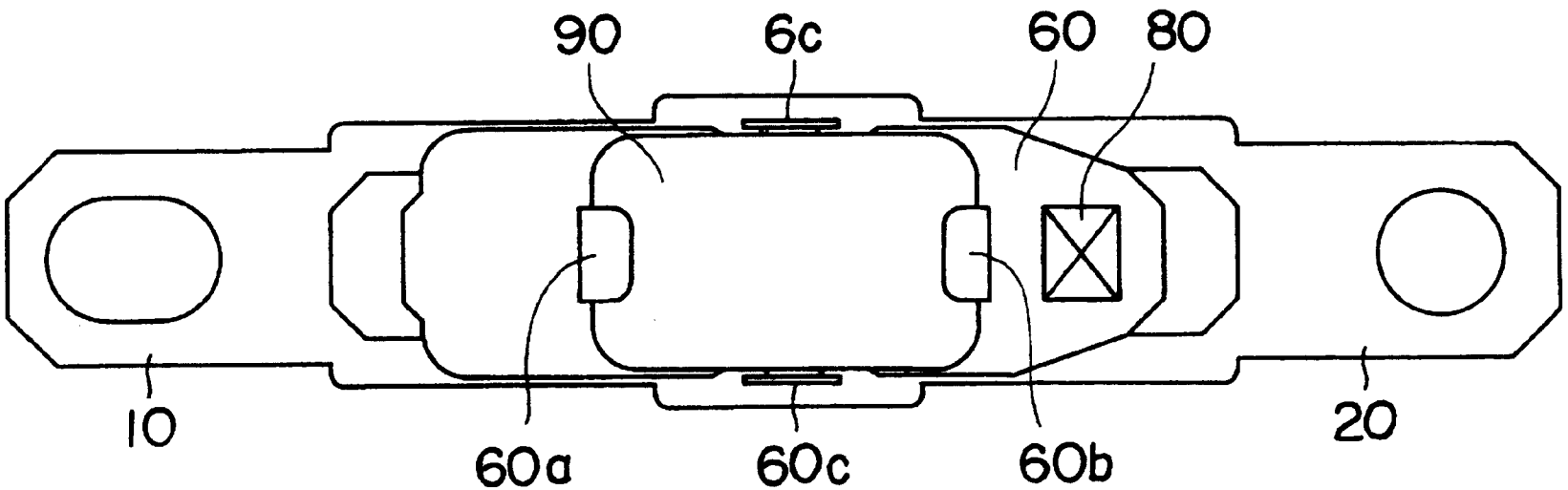
FIG. 2 is a plan view of the thermal protector shown in FIG. 1.
Figure 3:
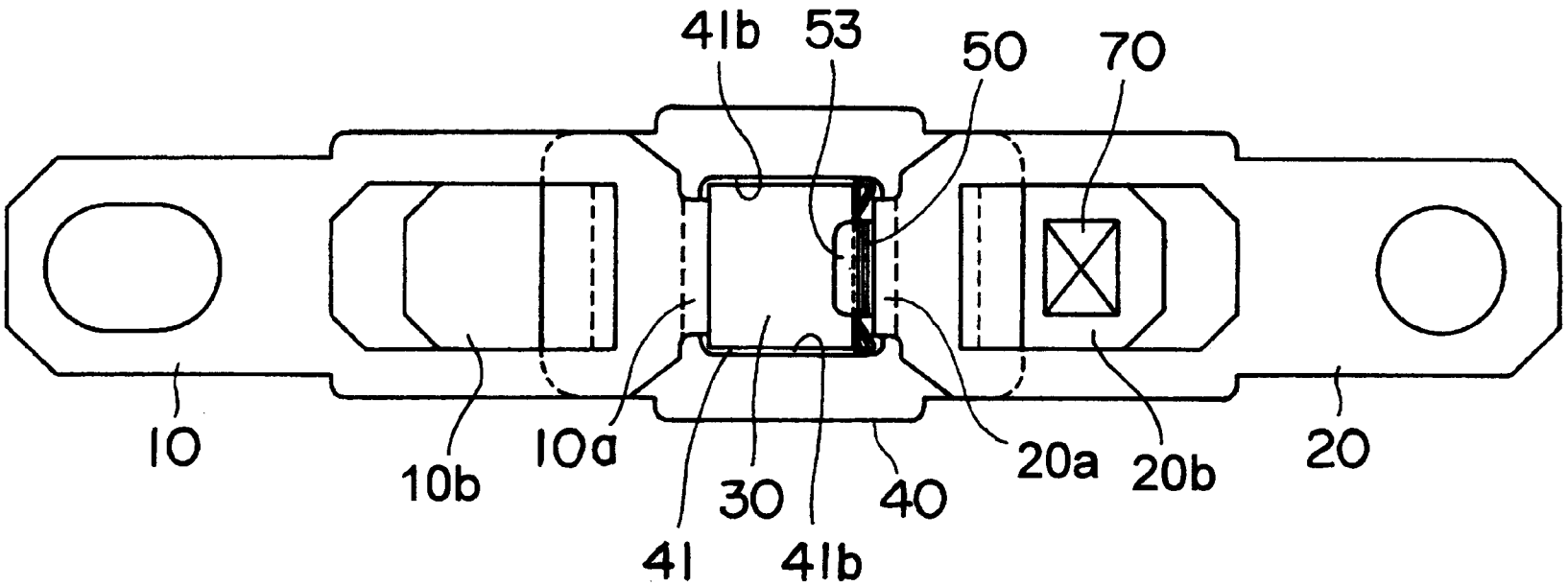
FIG. 3 is a bottom view of the thermal protector shown in FIG. 1.

FIG. 1 is a central longitudinal sectional view of an embodiment of a thermal protector in accordance with the present invention, and FIGS. 2 and 3 are a plan view and a bottom view of the thermal protector shown in FIG. 1.

A thermal protector in accordance with this embodiment includes first and second terminals 10 and 20 for connecting with external circuits, and a heat generating resistor 30 consisting of a rectangular parallelepiped interposed between the terminals 10 and 20.

For the first and second terminals 10 and 20, the proximal end portions thereof are bent 90 degrees upward to form contact portions 10*a* and 20*a*, respectively. Also, portions of terminals on the distal end side of the contact portions 10*a* and 20*a* are cut and raised to form support portions 10*b* and 20*b*, respectively.

The proximal portions of the terminals 10 and 20 are connected to each other via an electrical insulating resin block 40. The resin block 40 is molded integrally with the contact portions 10*a* and 20*a* and the support portions 10*b* and 20*b* so that a part of each of these elements is embedded. The resin block 40 is formed with a square concave 41, which is open to the bottom face side, in a central portion thereof.

The inner faces of the contact portions 10*a* and 20*a* are exposed from the inside faces of the concave 41 (see the dotted lines of FIG. 1). Therefore, the inner faces of the contact portions 10*a* and 20*a* are opposed to each other in the concave 41.

On each of the right and left end faces of the heat generating resistor 30, an electrode, not shown, is formed. One of the electrodes is in direct contact with the inner face of the left-hand contact portion 10*a*, and the other of the electrodes is in contact with the right-hand contact portion 20*a* via an elastic metal element 50, described later.

On the top face of the support portion 10*b* formed by cutting and raising the terminal 10, the proximal end portion of a movable plate 60 is fixed by welding or other means. Also, at the support portion 20*b* formed by cutting and raising the terminal 20, a fixed contact 70 is provided.

The movable plate 60 is formed of a metal plate having elasticity, and is provided with a movable contact 80, which is normally in contact with the fixed contact 70, at the distal end thereof. On the top face of the movable plate 60 is provided a bimetal plate 90. The bimetal plate 90 is held by holding elements 60*a*, 60*b* and 60*c* formed on the movable plate 60 so as to be capable of performing reversing operation.

As the heat generating resistor 30, a PTC (Positive Temperature Coefficient) element such as a positive thermistor is used. This PTC element is characterized by generating heat in a short period of time as electric current is carried.

Figure 4:
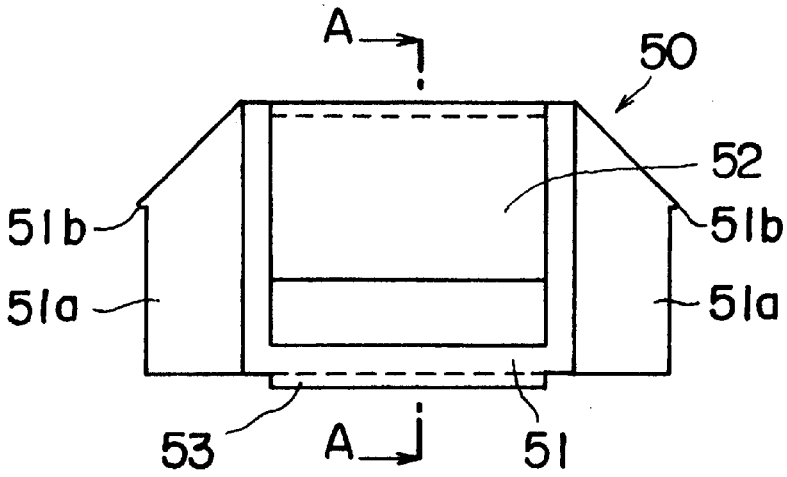
FIG. 4 shows a shape of an elastic metal element, FIGS. 4(*a*) and 4(*b*) being a front view and a bottom view, respectively, and FIG. 4(*c*) being a sectional view taken along the line A—A of FIG. 4(*a*)
Figure 4:
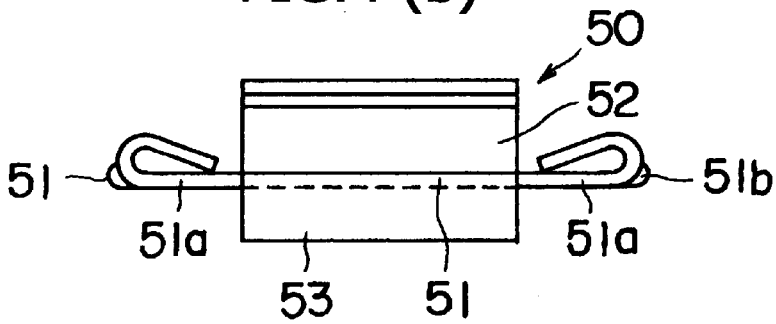
Figure 4:
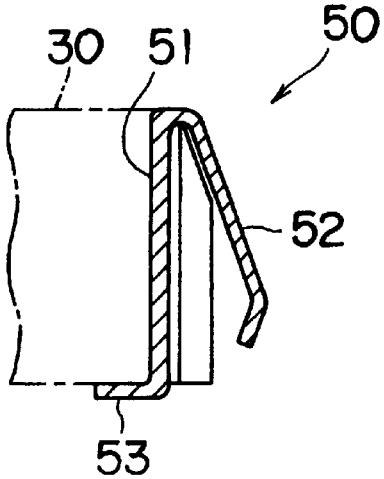
Figure 5:
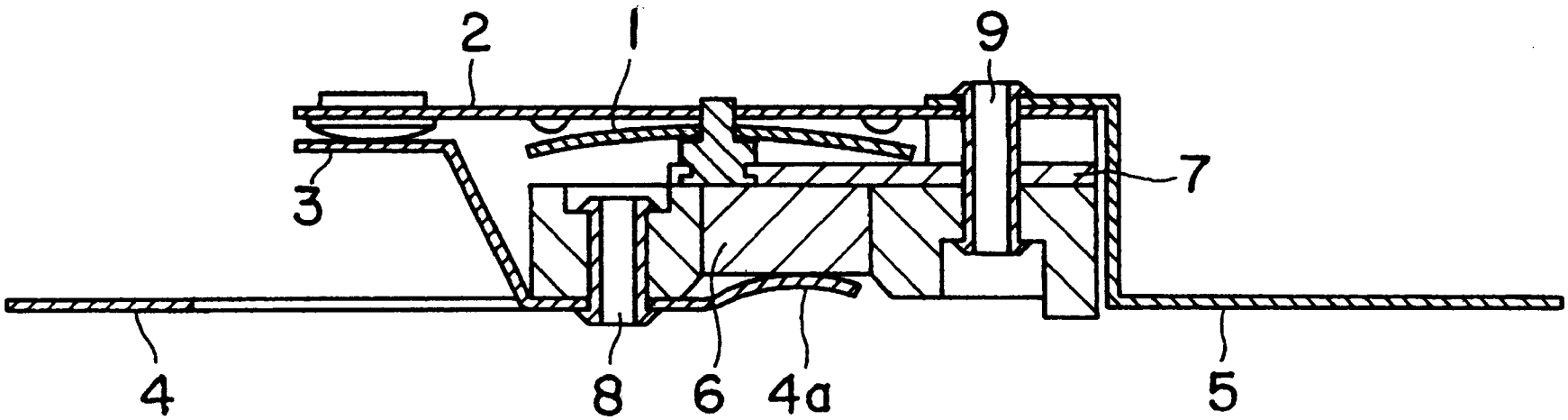
FIG.5 (PRIOR ART)
FIG. 5 is a longitudinal sectional view showing one example of a conventional thermal protector.

FIGS. 4(*a*) and 4(*b*) are a front view and a bottom view, respectively, of the aforementioned elastic metal element 50, and FIG. 4(*c*) is a sectional view taken along the line A—A of FIG. 4(*a*).

The elastic metal element 50 is formed by bending an elastic metal plate, and has a construction such as to include a flat portion 51 that is in contact with the electrode of the resistor 30, an elastic contact portion 52 bent slantwise downward from the top end of the flat portion 51, and a holding portion 53 bent 90 degrees in the direction opposite to the elastic contact portion 52 from the lower end of the flat portion 51.

The elastic metal element 50 is pressed in between the right-hand electrode of the heat generating resistor 30 and the contact portion 20*a* of the terminal 20 while the elastic contact portion 52 is deflected. The heat generating resistor 30 is urged to the left by the repulsion of the elastic contact portion 52. As a result, the left-hand electrode of the heat generating resistor 30 is pressed into contact with the inner face of the contact portion 10*a*, and the flat portion 51 of the elastic metal element 50 is pressed into contact with the right-hand electrode of the heat generating resistor 30.

On the other hand, when the elastic metal element 50 is pressed in, the holding portion 53 of the metal element 50 comes into contact with the bottom face of the heat generating resistor 30. Therefore, the heat generating resistor 30 is held in the concave 41 in the resin block 40 in the state in which the top face thereof is in contact with a bottom face 41*a* of the concave 41. In other words, the heat generating resistor 30 is held between the holding portion 53 and the bottom face 41*a*.

As shown in FIG. 4, for the elastic metal element 50, both sides of the flat portion 51 are extended to form extensions 51*a*, and a protrusion 51*b* is provided at the side end in the upper portion of each of the extensions 51*a*. When the elastic metal element 50 is pressed in, the protrusions 51*a* is strongly pressed against inner side faces 41*b* (see FIG. 3) of the concave 41 in the resin block 40 so as to prevent the elastic metal element 50 from coming out of the concave 41.

The thermal protector in accordance with this embodiment, having the above-described construction, is incorporated in electrical equipment accompanied by heat generation such as a fan heater, not shown, and is connected to a current carrying path for that electrical equipment via the terminals 10 and 20.

When the ambient temperature exceeds a predetermined reversing operation temperature due to abnormal heat generation in the electrical equipment caused by overload etc., the bimetal plate 90 of the thermal protector is reversed into a concave shape. When the bimetal plate 90 is reversed, the distal end of the movable plate 60 is raised upward by the warping force of the bimetal plate 90 with a protrusion 42 provided at the central portion on the top face of the resin block 40 serving as a fulcrum. As a result, the movable contact 80 separates from the fixed contact 70, by which the flow of electric current to the electrical equipment is ceased.

The cease of current flow decreases the heat generation in the electrical equipment. Even when the heat generation temperature becomes lower than the reversing operation temperature of the bimetal plate 90, this electricity shut-off state is maintained.

Specifically, the electrode formed on the left-hand face of the heat generating resistor 30 is electrically connected to the terminal 10 via the contact portion 10*a*, and the electrode formed on the right-hand face of the heat generating resistor 30 is electrically connected to the terminal 20 via the elastic metal element 50 and the contact portion 20*a*.

Thereupon, current flows in the heat generating resistor 30 due to a voltage (power source voltage given via the electrical equipment) between the terminals 10 and 20 at the same time the contact 80 separates from the contact 70. The heat generated in the heat generating resistor 30 due to this current flow continuously heats the bimetal plate 90. As a result, the electricity shut-off state of the electrical equipment is maintained.

A function of continuously maintaining the electricity shut-off state (self holding function) is deactivated, for example, by turning off a power switch for the electrical equipment.

According to the thermal protector in accordance with the above-described embodiment, the contact portions 10*a* and 20*a* are provided in the direction such as to intersect the bimetal plate 90, and the heat generating resistor 30 is mounted in the state in which the electrodes thereof are positioned at the right and left, so that no current carrying member exists on the top and bottom face sides of the heat generating resistor 30. Therefore, the dimension in the thickness direction can be decreased, so that a compact thermal protector can be realized.

When heat dissipation is insufficient, the heat generating resistor 30 consisting of a PTC element etc. exhibits a tendency for the quantity of generated heat to decrease due to the increase in electrical resistance caused by a rise in temperature of the resistor. According to the thermal protector in accordance with the above-described embodiment, however, three faces of the heat generating resistor 30 is in contact with the protector body including the resin block 40, the contact portions 10*a* and 20*a*, and the support portions 10*b* and 20*b*, so that the heat generated in the heat generating resistor 30 is dissipated efficiently. Therefore, a larger quantity of heat is generated in the heat generating resistor 30, by which the self holding function can be increased.

Furthermore, for the above-described thermal protector, since the elastic metal element 50 is interposed between the heat generating resistor 30 and the contact portion 20*a*, even if a distance between the contact portions 10*a* and 20*a* is changed by the expansion or contraction of the construction members such as the resin block 40 caused by a change in temperature of the surrounding environment, this change is absorbed by the elasticity of the elastic metal element 50. Therefore, the electrical contact of the electrodes of the heat generating resistor 30 with the contact portions 10*a* and 20*a* can always be maintained satisfactorily.

The elastic metal element 50 can also be interposed between the heat generating resistor 30 and the contact portion 10*a*. However, the elastic metal element 50 is preferably interposed between the heat generating resistor 30 and the contact portion 20*a* as in the case of the above-described embodiment from the viewpoint of increasing the heat transferability to the bimetal plate 90.

Specifically, assuming, for example, that the quantity of generated heat of the support portion 10*a* and the support portion 20*a* are equal, a larger quantity of heat flows into the bimetal plate 90 from the support portion 10*a* to which the movable plate 60 is joined. Therefore, the direct and wide-ranging contact of the heat generating resistor 30 to the contact portion 10*a* is advantageous for increase in heat transferability to the bimetal plate 90. For this reason, it is desirable to interpose the elastic metal element 50 between the heat generating resistor 30 and the contact portion 20*a*.

In the above-described embodiment, a groove 41*c* is formed in the central portion of the bottom face 41*a* of the concave 41 in the resin block 40 in the direction along the face of the electrode of the heat generating resistor 30 (direction perpendicular to the paper surface in FIG. 1).

The formation of the groove 41*c* provides a space between the bottom face 41*a* and the top face of the heat generating resistor 30, so that the electrical insulation performance between the electrodes of the heat generating resistor 30 can be enhanced when the thermal protector is used in a state of dew condensation.

The thermal protector in accordance with the above-described embodiment has a construction such that the movable plate 60 is operated by the bimetal plate 90. However, it is a matter of course that the construction for incorporating the heat generating resistor 30 can also be applied to a thermal protector of a type such that the movable contact is provided on the bimetal plate, that is, a type such that the movable plate is not used.

What is claimed is:

1. A thermal protector comprising first and second terminals connected to external circuits and a heat generating resistor provided with electrodes connected electrically to said first and second terminals on one end face and the other end face thereof, which is constructed so that first and second electrical contacts interposed between said first and second terminals are opened and closed by using the reversing operation of a bimetal plate, wherein a first contact portion is projectingly provided at a part of said first terminal in the direction so as to intersect said bimetal plate, and a second contact portion is projectingly provided at a part of said second terminal so as to be opposed to said first contact portion, and said heat generating resistor is interposed between said first and second contact portions so that the electrodes on one end face and the other end face of said heat generating resistor are brought into contact with said first and second contact portions, respectively.

2. The thermal protector according to claim 1, wherein a part of each of said first and second terminals is cut and raised to form first and second support portions, respectively, the proximal end portion of an elastic movable plate provided with said first contact at the distal end thereof is supported by said first support portion, and the second contact opposed to said first contact is supported by said second support portion, and said movable plate is operated by the reversing operation of said bimetal plate so that said first contact is brought into contact with and separated from said second contact.

3. The thermal protector according to claim 1 or 2, wherein an elastic element having electric conductivity is interposed between the electrode on one end face of said heat generating resistor and said first contact portion or between the electrode on the other end face of said heat generating resistor and said second contact portion.

4. The thermal protector according to claim 1 or 2, wherein an electrical insulating resin block is provided to connect said first and second terminals to each other, and said resin block is provided with a concave for housing said heat generating resistor so that said first and second contact portions are exposed from the opposed inside faces of said concave and the top face of said heat generating resistor is in contact with the bottom face of said concave.

5. The thermal protector according to claim 4, wherein a groove is formed in the bottom face of the concave in said resin block in the direction along the face of the electrode of said heat generating resistor.

6. The thermal protector according to claim 4, wherein said elastic element is provided with a holding portion for holding said heat generating resistor in cooperation with the bottom face of the concave in said resin block.

* * * * *